US006464326B1

(12) United States Patent
Weeks

(10) Patent No.: US 6,464,326 B1
(45) Date of Patent: Oct. 15, 2002

(54) WIPING APPARATUS FOR AN INK CARTRIDGE

(75) Inventor: David E. Weeks, Willseyville, NY (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/454,950

(22) Filed: Dec. 3, 1999

(51) Int. Cl.[7] ..... B41J 2/165
(52) U.S. Cl. ..... 347/33; 347/22
(58) Field of Search ..... 347/33, 24, 32, 347/22

(56) References Cited

U.S. PATENT DOCUMENTS

| | | | |
|---|---|---|---|
| 5,115,250 A | 5/1992 | Harmon | |
| 5,126,765 A | 6/1992 | Nakamura | |
| 5,489,927 A | 2/1996 | Harmon | |
| 5,612,721 A | 3/1997 | Ishize | |
| 5,617,124 A | 4/1997 | Taylor et al. | |
| 5,729,258 A | 3/1998 | Watabe et al. | |
| 5,745,133 A | 4/1998 | Hendricks et al. | |
| 5,786,830 A | 7/1998 | Su et al. | |
| 5,793,391 A | 8/1998 | Kawakami et al. | |
| 5,847,726 A | 12/1998 | Hori | |
| 5,880,755 A | 3/1999 | Fajour et al. | |
| 5,946,009 A | 8/1999 | Youn | |

FOREIGN PATENT DOCUMENTS

| | | | | |
|---|---|---|---|---|
| JP | 58194554 A | * | 11/1983 | ..... 347/24 |
| JP | 04187445 A | * | 7/1992 | ..... B41J/2/165 |
| JP | 5-116331 A | * | 5/1993 | ..... B41J/2/165 |
| JP | 7-237297 A | * | 9/1995 | ..... B41J/2/165 |

OTHER PUBLICATIONS

Grafstein, Paul and Schwarz, Otto B., "Pictorial Handbook of Technical Devices", Chemical Publishing Co., Inc., New York, pp. 128–129, copyright 1971.*

* cited by examiner

*Primary Examiner*—John Barlow
*Assistant Examiner*—An H. Do

(57) ABSTRACT

Apparatus for cleaning the nozzles of an ink jet cartridge that is mounted upon the carriage of a small point of sale printer. The carriage is arranged to carry one or more ink cartridges over a reciprocal path of travel through a printing station. The printer contains a drive roller mounted upon a shaft for advancing a substrate through the printing station. A rotor is journalled for free rotation on the shaft adjacent to one end of the drive roller. A rocker arm connects the rotor to a solenoid which when energized moves the rotor from an inoperative position into an operative position. A wiper blade is mounted upon the rotor which is adapted to wipe the nozzles on the ink cartridge when the rotor is in the operative position and to retract the blade out of contact with the nozzles when the rotor is moved into the inoperative position.

10 Claims, 4 Drawing Sheets

WIPING APPARATUS FOR AN INK CARTRIDGE

BACKGROUND OF THE INVENTION

This invention relates to a small point of sale ink jet printer, and, in particular, to apparatus for periodically cleaning the nozzles of one or more ink cartridges that are reciprocally moved through the printing station of the machine.

Ink jet printers utilize ink cartridges, sometimes referred to as pens, which are arranged to dispense drops of ink onto a substrate such as paper to lay down a prescribed image as the carriage, in which one or more cartridges are supported, moves back and forth through a printing station. A cartridge generally contains a printhead having a series of small nozzles through which ink droplets are propelled onto the substrate. An ink ejection mechanism is located inside the cartridge that responds to input signals provided through terminals in the printhead to lay down the desired image.

In larger printers there is typically provided one or more nozzle cleaning stations containing wiper blades that are arranged to periodically move into contact with the nozzles to remove unwanted residual ink from the nozzle area before it can dry. The carriage, which can contain one or a plurality of ink cartridges, is programed to periodically move into the cleaning station or stations during each cleaning cycle. The cleaning station or stations are typically outside of the normal path of travel of the carriage and space for housing the wiper blade and related components is not a serious consideration. In a smaller point of sale printer, however, little space is available for a separate cleaning station. This space problem becomes more pronounced when more than one ink cartridge is mounted upon the carnage.

SUMMARY OF THE INVENTION

It is therefore an object of the present invention to improve relatively small point of sale ink jet printers.

It is a further object of the present invention to provide a compact nozzle cleaning mechanism for use in a small ink jet printer.

A still further object of the present invention is to provide a nozzle cleaning capability for a small two color point of sale ink jet printer containing a pair of ink cartridges mounted within a single carriage which does not require the range of movement of the carriage to be expanded beyond its normal printing range.

Another object of the present invention is to provide a compact, yet simple blade cleaning mechanism for wiping the nozzles of the ink cartridges of a two color ink jet printer.

These and other objects of the present invention are attained by means of a wiper blade cleaning mechanism that includes a rotor mounted for free rotation upon the main drive shaft of an ink jet printer upon which is mounted a drive roller that is used to advance a substrate through the printing station of the machine. The rotor, in one embodiment of the invention, is mounted immediately adjacent one end of the drive roller and is connected to an actuator through a rocker arm which moves the rotor between an inoperative position and an operative position. A wiper blade is mounted into said rotor that extends outwardly from the rotor's rim. The blade is generally perpendicularly aligned with the path of travel of the ink cartridge carriage. When the rotor is in the operative position, the blade is adapted to engage the nozzles of an ink cartridge mounted in the carriage as the cartridge is reciprocated along the path of travel through the printing station. Placing the rotor in the inoperative position withdraws the blade out of the carriage's path of travel and thus out of engagement with said ink cartridge nozzles.

In another embodiment of the invention a two color printer is equipped with a carriage containing two side-by-side ink cartridges. A pair of rotors are mounted on the drive roller shaft with each rotor being adjacent one end of the drive roller. The wiper blade of one rotor is adapted to clean the nozzles of an adjacent ink cartridge while the blade of the other rotor is adapted to clean the second ink cartridge as the carriage reciprocates over its normal path of travel.

BRIEF DESCRIPTION OF THE DRAWING

For a better understanding of these and other objects of the present invention, reference will be made to the following detailed description of the invention which is to be read in association with the accompanying drawings, wherein.

DETAILED DESCRIPTION OF THE INVENTION

Figure 1:
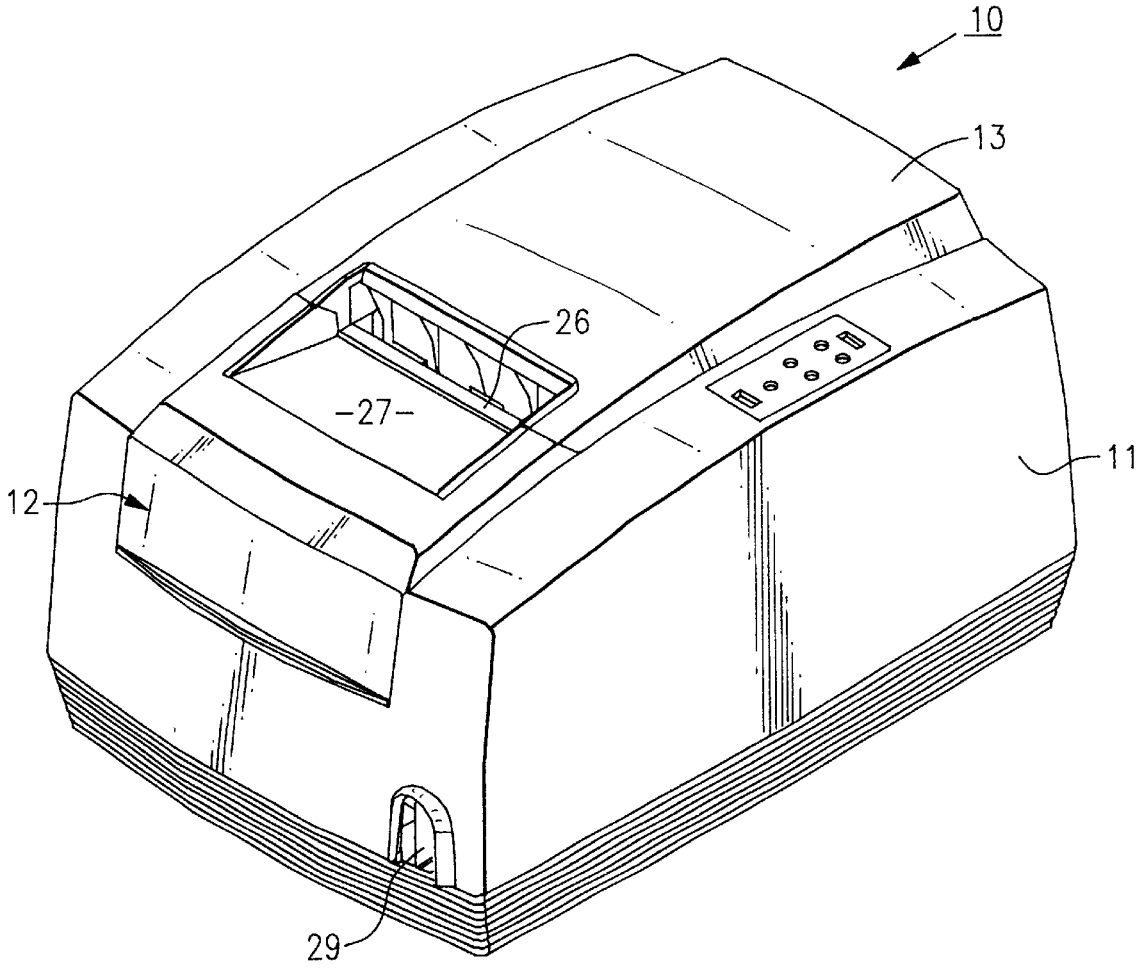
FIG. 1 is a perspective view illustrating a small point of sale ink jet printer embodying the teachings of the present invention.
Figure 2:
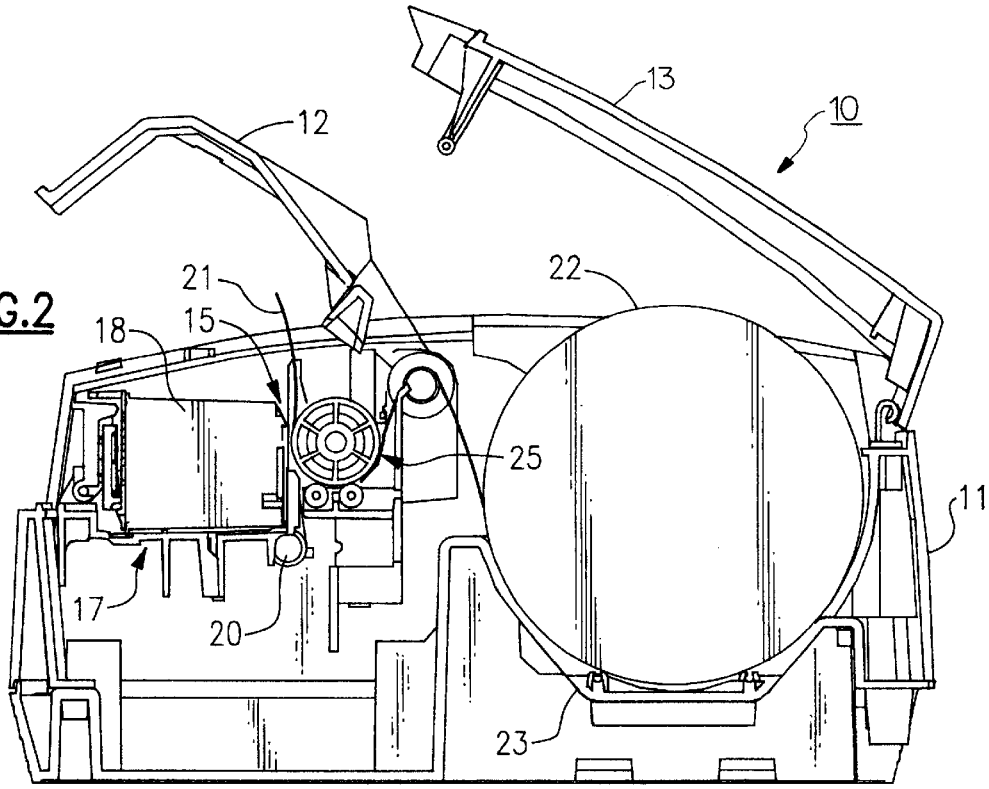
FIG. 2 is a side elevation, in section, of the printer shown in FIG. 1 with the covers of the printer being raised to an open position.
Figure 3:
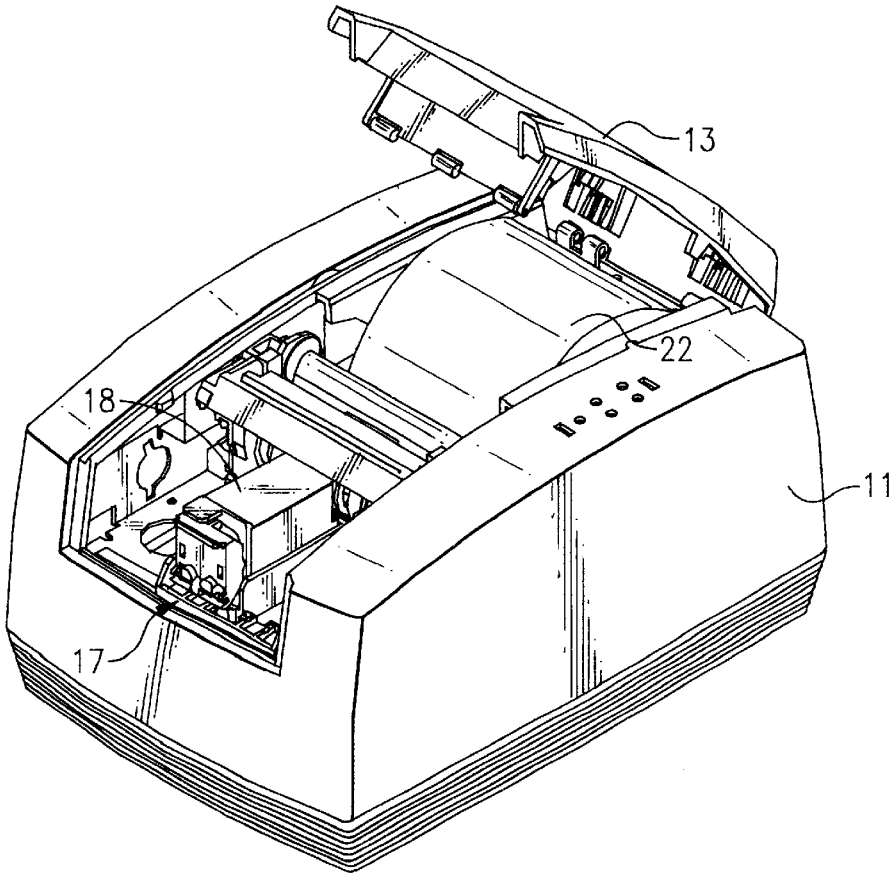
FIG. 3 is a perspective view of the printer showing the rear cover raised and the front cover removed.
Figure 4:
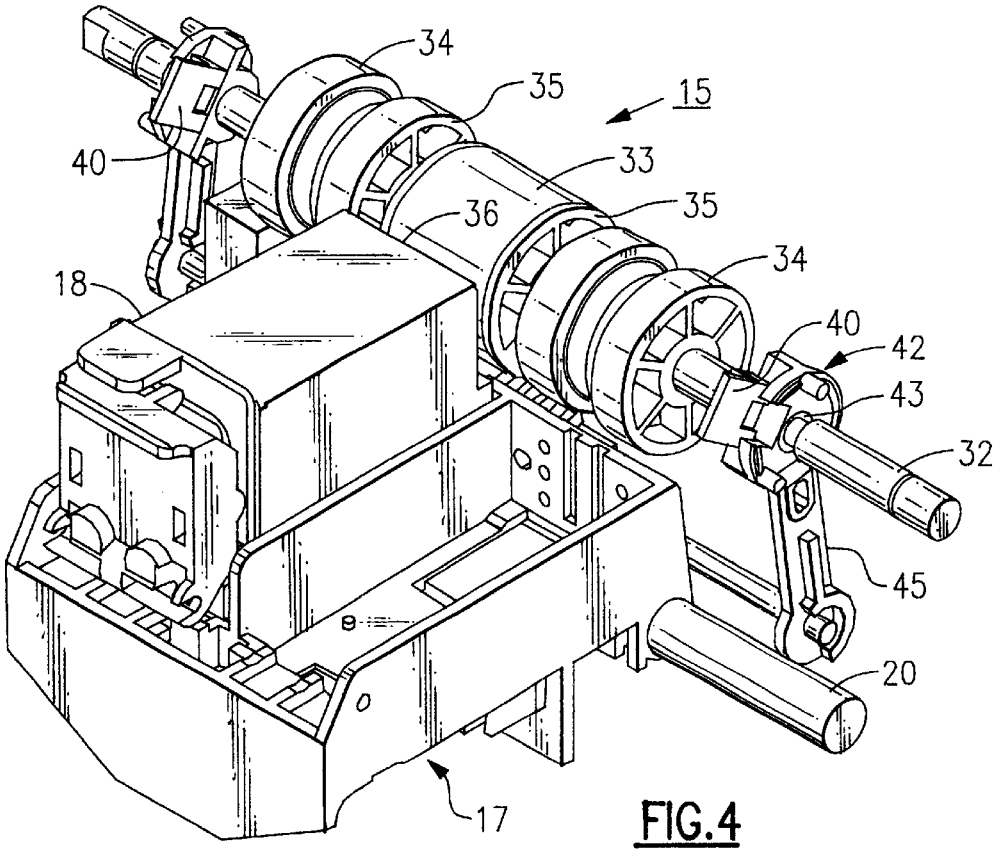
FIG. 4 is a partial enlarged perspective view showing the printing station of the machine in further detail.

Referring initially to FIGS. 1–3, there is illustrated a small point of sale ink jet printer generally referenced 10. The printer housing includes a base 11 upon which is pivotally mounted a front cover 12 and a rear cover 13. The front cover, when opened as shown in FIG. 2, provides access to the printing station 15 of the machine along with an ink cartridge carriage 17 that is adapted to support a pair of ink-cartridges 18, only one of which is shown in FIG. 3. The carriage rides back and forth upon a horizontally disposed guide rail 20 (FIG. 2) to selectively position the ink cartridge nozzles within the printing station. The travel of the carriage is such that each ink cartridge can scan across the full width of a substrate 21 that is advanced into the printing station from a paper supply roll 22. The supply roll is contained within a bin 23 located in the rear section of the base 11. The rear cover 13, when opened, provides ready access to the paper roll bin 23 so that a depleted roll can be easily removed from the housing and a fresh roll loaded into the printer. Although the substrate material will be referred to herein as paper, it should be evident that this term is used in the broadest sense possible and includes any material known and used in the art upon which an ink jet image can be printed. Although not shown, the leading section of the paper roll is automatically advanced by a drive roller 25 (FIG. 2) through the printing station and then through a top opening 26 (FIG. 1) in the housing into a read out station 27. The leading section of the paper bearing the printed indicia can be either manually or automatically separated from the body of the roll when each printing cycle is completed.

As is well known in the art, input data is provided to the printer from a processor through an input port 29 (FIG. 1) located in the front face of the printer. Data from the processor is used to control the motion of the carriage and the jetting of ink from each of the cartridges so that the desired information is printed upon the substrate. One ink cartridge contains a first color ink such as black, while the second ink cartridge contains a second color ink such as red. Accordingly, receipts printed by the machine can clearly differentiate one type of information from another. As the carriage moves in one direction, the first cartridge in the direction of travel must travel beyond the side margin of the drive roll so that the second cartridge can fully scan across the width of the paper. Accordingly, each cartridge must pass beyond one end or the other of the drive roller as the carriage moves back and forth across the printing station.

Turning now to FIGS. 4–8, there is shown in greater detail the printing station 15 of the machine. The drive roller 25, which advances paper through the printing station, is mounted for rotation upon a drive shaft 32. The drive roller includes a platen section 33 and a pair of friction end rolls 34–34. Circumferential grooves 35 are furnished in the platen in which fingers can ride to lift the paper from the roller as it moves out of the printing station. The drive shaft 32 is connected via a gear train (not shown) to a drive motor stored in the base of the housing which is controlled by an input from the processor.

As pointed out above, the ink jet nozzles, which are contained in the printhead on the front wall 36 of each ink cartridge, must be periodically cleaned after a given number of characters have been printed, or after the termination of a printing cycle or any other convenient interval that will insure that the nozzles are maintained in efficient working order. Cleaning of the nozzles is carried out by a pair of wiper blades 40-40 that are secured in rotors 42. The rotors are mounted adjacent both ends of the drive roller upon the drive shaft. The rotors are equipped with roller bearings 43 which permit the rotors to rotate freely upon the drive shaft or to remain in a stationary position while the drive shaft is turned by the drive system.

The wiper blades can be fabricated from any suitable material known and used in the art, such as an elastomeric material, having a modulus of elasticity that will permit the blades to apply a cleaning force against the nozzles when brought into biasing contact with the printhead. The blades preferably are flat planar members and can be furnished with a contoured cutting edge for making efficient wiping contact with the nozzle during the cleaning process.

Figure 7:
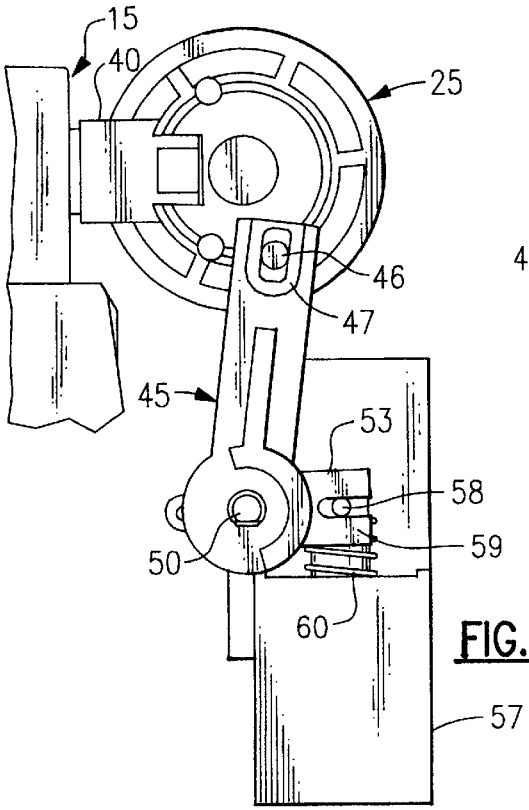
FIG. 7 is a partial enlarged side view showing the wiper blade of the present invention in cleaning engagement with the nozzles of an ink cartridge mounted in the printer carriage.

As noted above, the carriage 17 rides upon a guide rail 20. The guide rail is in parallel alignment with the drive shaft 32 so that the ink cartridge nozzles move back and forth over a prescribed path of travel through the printing station. As will be explained in further detail below, the blades are contained within the rotors so that they are generally perpendicular to the linear path of travel through which the nozzles move. The rotors are movable upon the drive shaft so that the blades can be brought into a first operative position as illustrated in FIG. 7 wherein the blades wipe across the nozzles as the carriage moves one of the ink cartridges past an adjacent rotor. The carriage is provided with a sufficient range of travel so that the blade at one end of the drive roll can clean the nozzles on the outside cartridge when the carriage approaches one end of travel and the opposite blade will similarly clean the nozzle on the other cartridge when the carriage approaches the opposite end of travel.

Figure 5:
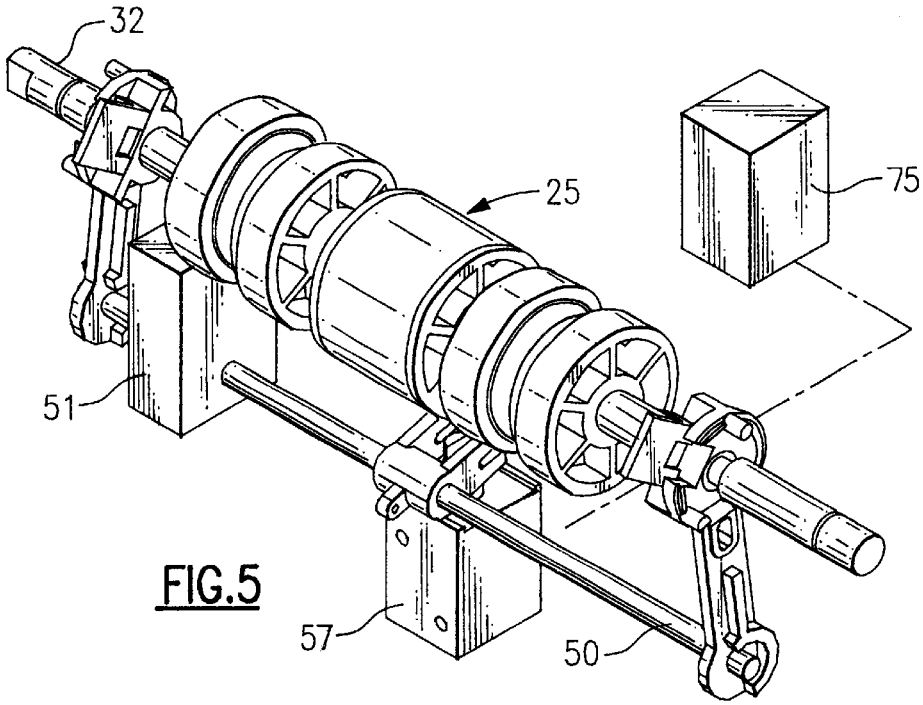
FIG. 5 is a view similar to that of FIG. 4 with the ink cartridge carriage removed.
Figure 8:
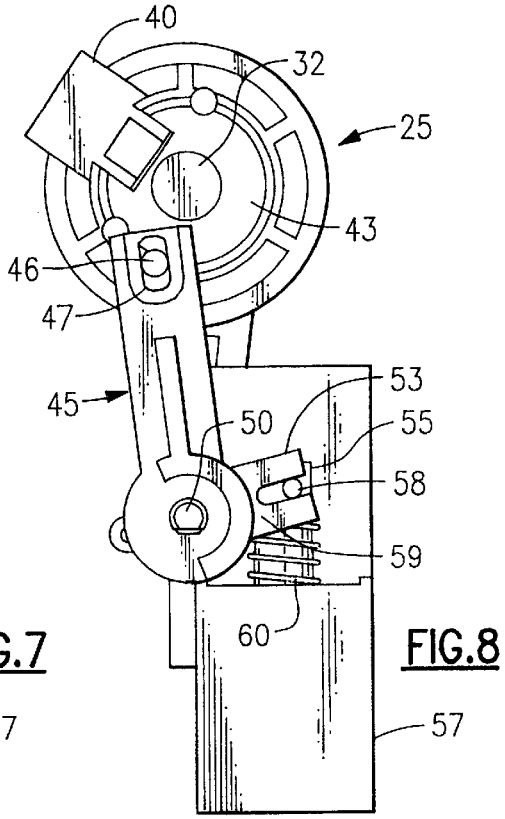
FIG. 8 is a view similar to FIG. 7 showing the wiper blade in a retracted position remote from the ink cartridge nozzles.
Figure 6:
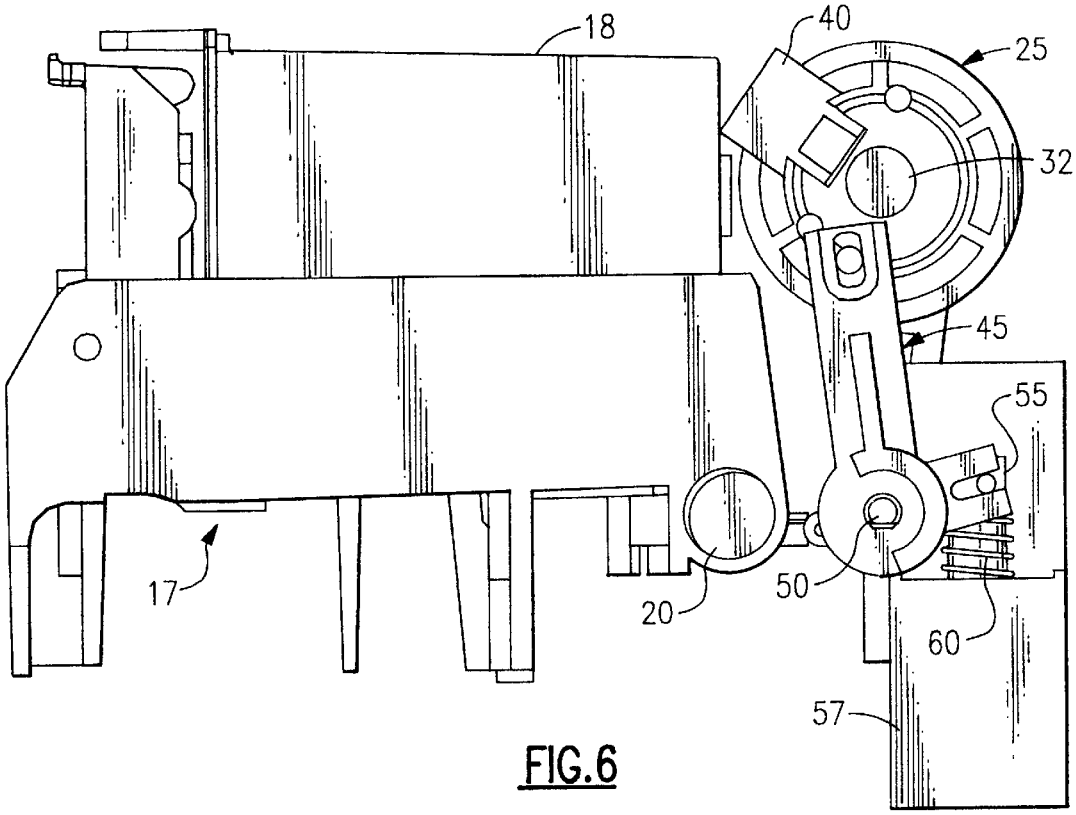
FIG. 6 is a further enlarged partial side elevation showing the cleaning apparatus of the present invention and the carriage of the printer.

As best illustrated in FIGS. 6–8, each rotor is pivotally connected to one end of a rocker arm 45 by means of a pin 46 that is adapted to ride in a slotted hole 47 formed in the arm. The opposite end of each arm is secured to a common elongated bar 50 that is journalled for rotation in a bearing block 51 (FIG. 5). A crank arm 53 is secured at one end to the central part of the bar and the opposite end of the crank arm is coupled to actuator rod 55 of a solenoid 57 by means of a stub shaft 58 that is arranged to ride in a slot 59 formed in the distal end of the crank arm.

A compression spring 60 is mounted upon the actuator rod of the solenoid and is adapted to urge the crank arm into the position shown in FIG. 8 when the solenoid is deenergizer. This, in turn, causes the rotors to be positioned to place the wiper blades in a raised or inoperative well clear of the path of travel of the carriage.

Energizing the solenoid will cause the rocker arms to be moved to the position as illustrated in FIG. 7 placing the rotors and thus the wiper blades in an operative position within the path of travel of the ink cartridge nozzles. Accordingly, the nozzles will be cleaned by the blade as the carriage reciprocates through the two extreme points of travel.

The energizing and deenergizing of the solenoid is controlled through the processor 75 which is programmed to periodically initiate a cleaning cycle based upon a machine function that is related to the number of times the nozzles might be cycled. As can be seen, the present nozzle cleaning apparatus is relatively simple utilizing a minimum amount of parts. The apparatus has the capability to respond quickly to input commands from a processor or the like whereby the cleaning cycle can be carried out rapidly while the machine is printing or during a lull between printing runs. As should be further evident from the disclosure above, the present cleaning system is ideally suited for use in a two color printer because the nozzle cleaning operation can be achieved within the normal path of travel of the ink cartridge carriage thereby requiring no additional machine space. This later feature is most attractive in regard to point of sale printers where space is usually at a premium.

Although the present invention has been described with specific regard to a small two color point of sale printer, it should be clear that the invention has broader application and can be used in one-color machines or large multi-color machines.

While the present invention has been particularly shown and described with reference to the preferred mode as illustrated in the drawing, it will be understood by one skilled in the art that various changes in detail may be effected therein without departing from the spirit and scope of the invention as defined by the claims.

I claim:

1. Apparatus for cleaning the nozzles of an ink jet cartridge that is mounted within a carriage arranged to reciprocate along a path of travel through a printing station of an ink jet printer, said apparatus including:

a drive roller unit mounted upon a shaft for advancing a substrate through said printing station, a rotor mounted for free rotation upon said shaft adjacent to one end of said drive roller, a wiper blade mounted in said rotor that extends outwardly from said rotor whereby said blade can pass into cleaning contact with said nozzles in an ink cartridge as said carriage moves over said path of travel, actuator means for rotating said rotor between a first operative position wherein said blade is located in the path of travel of said carriage and a second inoperative position wherein said blade is out of said path of travel of said carriage, and wherein said actuator means includes a rocker arm that is connected at one end to said rotor and at the other end to a drive means for moving said rocker arm between a first position wherein said rotor is placed in said operative position and a second position wherein said rotor is in the inoperative position.

2. The apparatus of claim 1 wherein said drive means includes a solenoid that is connected to said rocker arm through a crank arm whereby said rocker arm is moved between said first and second positions.

3. The apparatus of claim 2 wherein said rotor is moved to an inoperative position when the solenoid is deenergized and into an operative position when the solenoid is energized.

4. The apparatus of claim 3 that further includes control means for periodically energizing said solenoid.

5. The apparatus of claim 4 wherein said blade is mounted in said rotor perpendicular to the path of travel of said carriage.

6. An ink jet printer that includes:

a carriage for reciprocating a pair of ink cartridges along a path of travel through a printing station, a drive roller mounted upon a shaft for advancing a substrate through said printing station, a rotor mounted for free rotation upon said shaft adjacent to both ends of said drive roller, a wiper blade mounted in each of said rotors that extend outwardly from each rotor so that the blades can pass into cleaning contact with the nozzles of one of said ink cartridges as the carriage moves over said path of travel, and an actuator means for rotating each of said rotors between a first operative position wherein said blades are located in the path of travel of said carriage and a second inoperative position wherein said blades are out of said path of travel of said carriage, wherein said actuator means includes a pair of rocker arms, each of which is connected at one end to one of said rotors and at the other end to a drive means for moving the rotors between a first position wherein said rotors are placed in said operative position and a second position wherein said rotors are placed in said inoperative position.

7. The apparatus of claim 6 wherein said drive means further includes a bar connected to said other end of said rocker arms and a crank arm for rotating said bar whereby said rocker arms are moved between said first and second positions.

8. The apparatus of claim 7 that further includes a solenoid attached to said crank arm whereby said rocker arms are moved to said first position when the solenoid is energized and to said second position when the solenoid is deenergized.

9. The apparatus of claim 8 that further includes control means for periodically energizing said solenoid.

10. The apparatus of claim 6 wherein each blade is a flat member that is mounted in a rotor perpendicular to the path of travel of said carriage.

* * * * *